US010219606B1

(12) United States Patent
Boncimino et al.

(10) Patent No.: US 10,219,606 B1
(45) Date of Patent: Mar. 5, 2019

(54) HAIR COLLECTION DEVICE

(71) Applicants: Nicholas Santo Boncimino, Westminster, CO (US); Alan Douglas Van Lohn, Phoenix, AZ (US); Anthony Burton Tippett, Phoenix, AZ (US)

(72) Inventors: Nicholas Santo Boncimino, Westminster, CO (US); Alan Douglas Van Lohn, Phoenix, AZ (US); Anthony Burton Tippett, Phoenix, AZ (US)

( * ) Notice: Subject to any disclaimer, the term of this patent is extended or adjusted under 35 U.S.C. 154(b) by 0 days.

(21) Appl. No.: 15/807,150

(22) Filed: Nov. 8, 2017

(51) Int. Cl.
*A45D 44/16* (2006.01)
*E03C 1/26* (2006.01)
*A47K 1/06* (2006.01)

(52) U.S. Cl.
CPC ..... *A45D 44/16* (2013.01); *E03C 1/26* (2013.01); *A47K 1/06* (2013.01)

(58) Field of Classification Search
CPC .. A47K 1/06; E03C 1/26; E03C 1/264; E03C 1/262; A45D 44/16
USPC ..... 4/655, 657, 658, 292, 580; 428/101; 15/160, 161
See application file for complete search history.

(56) References Cited

U.S. PATENT DOCUMENTS 3,702,013 A * 11/1972 Gebert ..... E03C 1/26 4/288
3,750,226 A * 8/1973 Morgan ..... A47K 7/024 15/160
4,418,432 A * 12/1983 Vidal ..... A47K 1/14 210/163
4,420,850 A * 12/1983 Moore ..... A47K 7/04 15/21.1
4,671,976 A * 6/1987 Vidal ..... A47K 1/14 4/286
4,825,477 A * 5/1989 Aranda ..... E03C 1/262 4/286
5,376,264 A * 12/1994 Betancourt ..... B01D 29/01 210/166
6,173,455 B1 * 1/2001 Nordstrom ..... E03C 1/264 4/292
7,975,323 B2 * 7/2011 Dees ..... E03C 1/264 4/292
8,505,551 B2 * 8/2013 Moretti ..... A47K 7/026 132/200

(Continued)

*Primary Examiner* — Erin Deery
(74) *Attorney, Agent, or Firm* — Gulf Coast Intellectual Property Group

(57) ABSTRACT

A hair collection device that is configured to be secured to a shower or bathtub wall that is operable to provide a location for collection of shed hair strands. The hair collection member includes a base member that is planar in manner and manufactured from a semi-rigid material. The base member is secured to a shower wall utilizing a suitable adhesive. Superposed the base member and adjacent thereto is a hair collection member. The hair collection member is manufactured from a foam pad material and further includes an adhesive disposed on a side thereof. A first fastener and a second fastener are present on the base member and the hair collection member wherein the first fastener and second fastener facilitate the releasable coupling of the base member and the hair collection member. A protective film is present on the hair collection member and is removed prior to use thereof.

3 Claims, 3 Drawing Sheets

(56) References Cited

U.S. PATENT DOCUMENTS

| | | | | |
|---|---|---|---|---|
| 2005/0084649 | A1* | 4/2005 | Patlakh | A47K 7/026<br>428/101 |
| 2010/0175213 | A1* | 7/2010 | Fitzwater | A46B 5/0054<br>15/160 |
| 2018/0064233 | A1* | 3/2018 | Riley | A46B 3/005 |

* cited by examiner

HAIR COLLECTION DEVICE

PRIORITY UNDER 35 U.S.C SECTION 119(E) & 37 C.F.R. SECTION 1.78

This nonprovisional application claims priority based upon the following prior United States Provisional Patent Application entitled: Mane Contain, Application No. 62/492,921 filed May 1, 2017, in the name of Nicholas Santo Boncimino, which is hereby incorporated by reference for all purposes.

FIELD OF THE INVENTION

The present invention relates generally to cleaning apparatus, more specifically but not by way of limitation, a hair collection device that is releasably secured to a wall in a shower or bathroom wherein the hair collection device includes a hair collection member that is operable to provide retaining of hair for subsequent disposal.

BACKGROUND

The average human head has approximately one hundred thousand strands of hair. Daily hair loss is considered normal and occurs naturally as part of the growing process. The average women looses between fifty to one hundred and fifty strands of hair in a day. This shedding is completely natural but does lead to challenges particularly for those women that have long hair. One of the most common places that women shed hair is in the shower. This occurs in part due to hygiene practices such as but not limited to shampooing of the hair. During this process, hair strand shedding can be exacerbated due to the stress of washing the hair. As the hair strands are shed, they will accumulate in the bottom of the shower and often be directed by the flow of water towards the drain. Over a short period of time this can result in poor drain performance precipitating the requirement for plumbing repairs and/or maintenance.

Most individuals will attempt to collect the hair during the act of other activities such as cleaning the shower or bath. While this helps alleviate the aforementioned plumbing problems it is more desirable to collect the hair on a more frequent basis. Some individuals will collect the shed hair strands during the bathing process but often find that maintain the collection of hair in an organized manner for subsequent disposal is difficult. Bathroom shower and tub surfaces are often tile or other material and as such any collected hair can easily be removed by splashing water. Attempts are often made to place collected hair on a ledge or similar item but again these surfaces do not provide effective retention of the collected hair.

Accordingly, there is a need for a hair collection device that is releasably secured to a shower or bathtub wall wherein the hair collection device includes a hair collection member that is configured to provide retention of collected hair strands for subsequent disposal thereof.

SUMMARY OF THE INVENTION

It is the object of the present invention to provide a hair collection device that is releasably secured to a shower or bathtub wall that is operable to provide a location for shed hair strands so as to collect and subsequently dispose.

Another object of the present invention is to provide a hair collection device configured to releasably retain shed hair strands that includes base member wherein the base member is configured to be releasably secured to a shower wall.

A further object of the present invention is to provide a hair collection device that is releasably secured to a shower or bathtub wall that is operable to provide a location for collected shed hair strands that further includes a hair collection member.

Still another object of the present invention is to provide a hair collection device configured to releasably retain shed hair strands wherein the hair collection member is superposed the base member and releasably secured thereto.

An additional object of the present invention is to provide a hair collection device that is releasably secured to a shower or bathtub wall that is operable to provide a location for collected shed hair strands wherein the hair collection member is a foam pad.

Yet a further object of the present invention is to provide a hair collection device configured to releasably retain shed hair strands wherein the hair collection member further includes an adhesive disposed on the surface thereof.

Another object of the present invention is to provide a hair collection device that is releasably secured to a shower or bathtub wall that is operable to provide a location for collected shed hair strands wherein the hair collection member is provided in a plurality of shapes and colors.

An additional object of the present invention is to provide a wherein the base member is manufactured from a material such as but not limited to acrylic.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
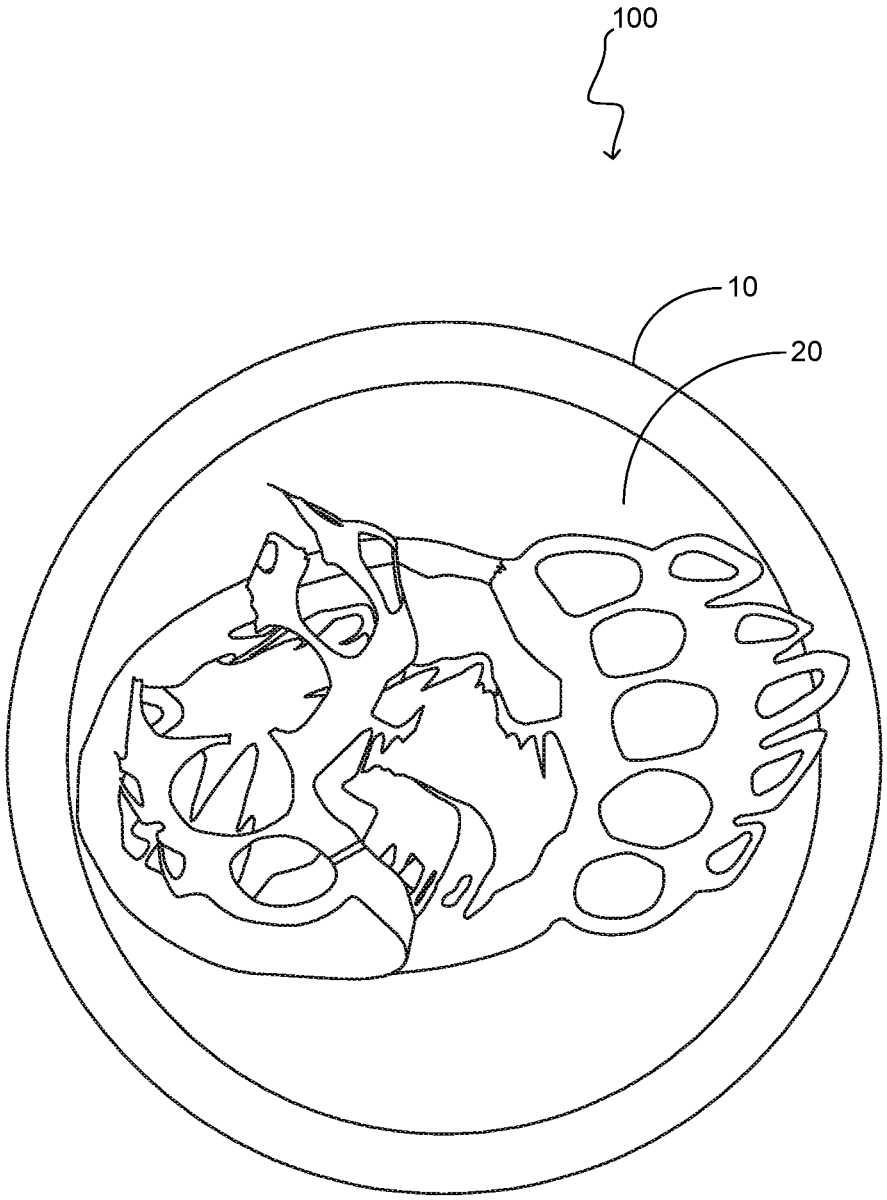
FIG. 1 is a top view of an embodiment of the present invention.

Referring now to the drawings submitted herewith, wherein various elements depicted therein are not necessarily drawn to scale and wherein through the views and figures like elements are referenced with identical reference numerals, there is illustrated a hair collection device 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Figure 3:
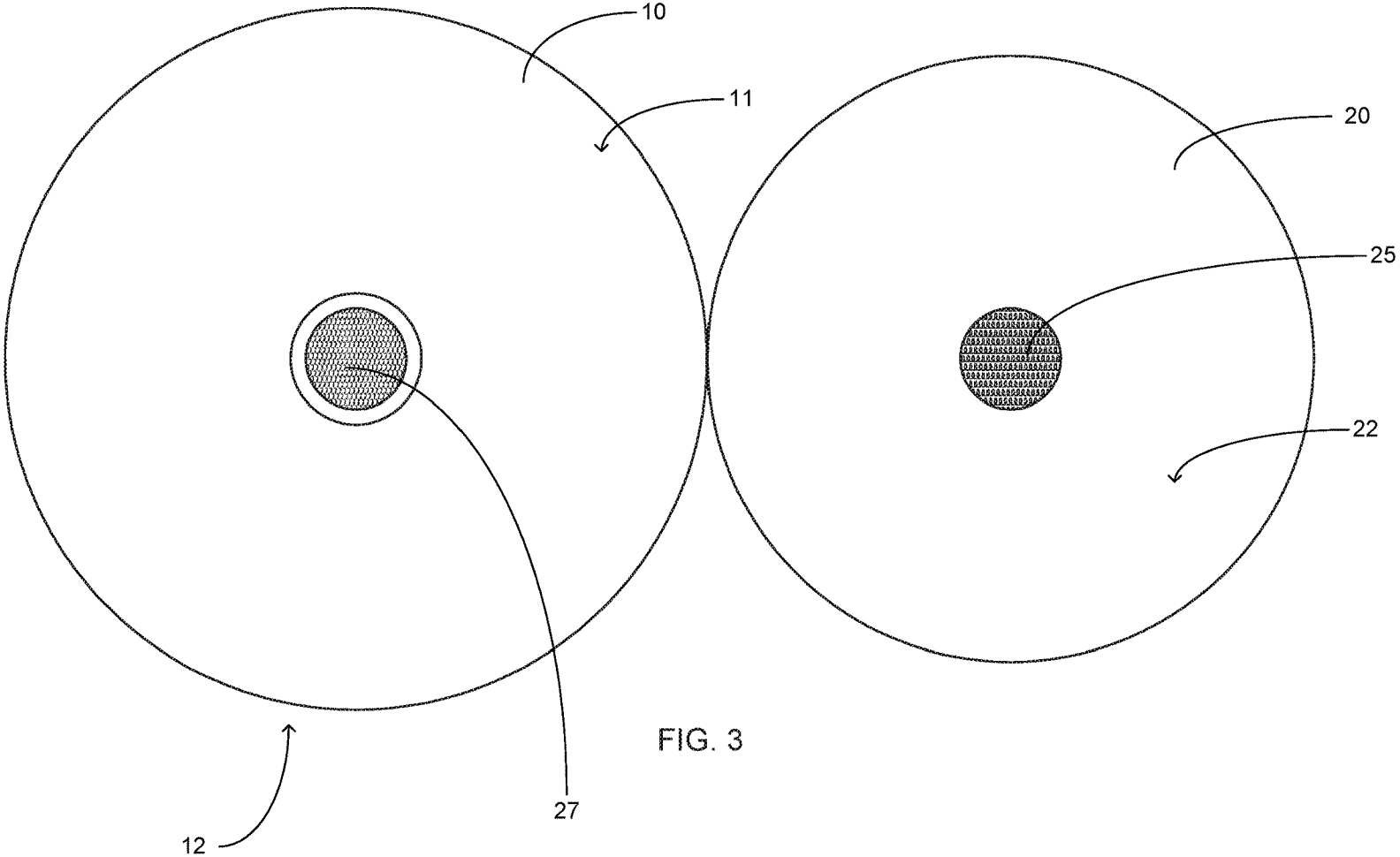
FIG. 3 is a view of the base plate member and hair collection member of the present invention in a separated position.

Referring in particular to FIGS. 1 and 3 submitted herewith, the hair collection device 100 includes a base member 10. The base member 10 planar in manner and manufactured from a semi-rigid material such as but not limited to plastic. The base member 10 includes a first side 11 and a second side 12. The base member 10 is configured to be releasably secured to a shower or bathtub wall. Securing of the base member 10 to a shower or bathtub wall is accomplished utilizing conventional adhesive foam tape (not illustrated herein) that is present in the second side 12 of the base member 10. It is contemplated within the scope of the present invention that the base member 10 could utilize alternate elements either separately or in conjunction with adhesive foam tape in order to facilitate the securing of the base member 10 to a shower or bathtub wall. While the base member 10 is illustrated herein as being annular in shape, it is further contemplated within the scope of the present invention that the base member 10 could be provided in alternate shapes and size. Furthermore, it should be understood within the scope of the present invention that the base member 10 could be provided in numerous different colors.

A hair collection member 20 is releasably secured to the first side 11 of the base member 10. The hair collection member 20 includes a first side 21 and second side 22. The second side 22 of the hair collection member 10 is superposed and adjacent the first side 11 of the base member 10 when the hair collection device 100 is in its assembled state as shown herein in FIG. 1. The second side 22 of the hair collection member 20 has centrally located thereon a first fastener 25. The first fastener 25 is configured to releasably secure to a second fastener 27 that is centrally located on the first side 11 of the base member 10. It is contemplated within the scope of the present invention that the first fastener 25 and second fastener 27 could be manufactured from hook and loop material. Those skilled in the art should recognize that the first fastener 25 and second fastener 27 could be manufactured from alternate materials capable of achieving the objective of releasably securing the hair collection member 20 to the base member 10. It is further contemplated within the scope of the present invention that the first fastener 25 and second fastener 27 could be located in alternate positions instead of the centralized location described and illustrated herein. Furthermore, it is contemplated within the scope of the present invention that the hair collection device 100 could include alternate quantities of the first fastener 25 and second fastener 27.

Figure 2:
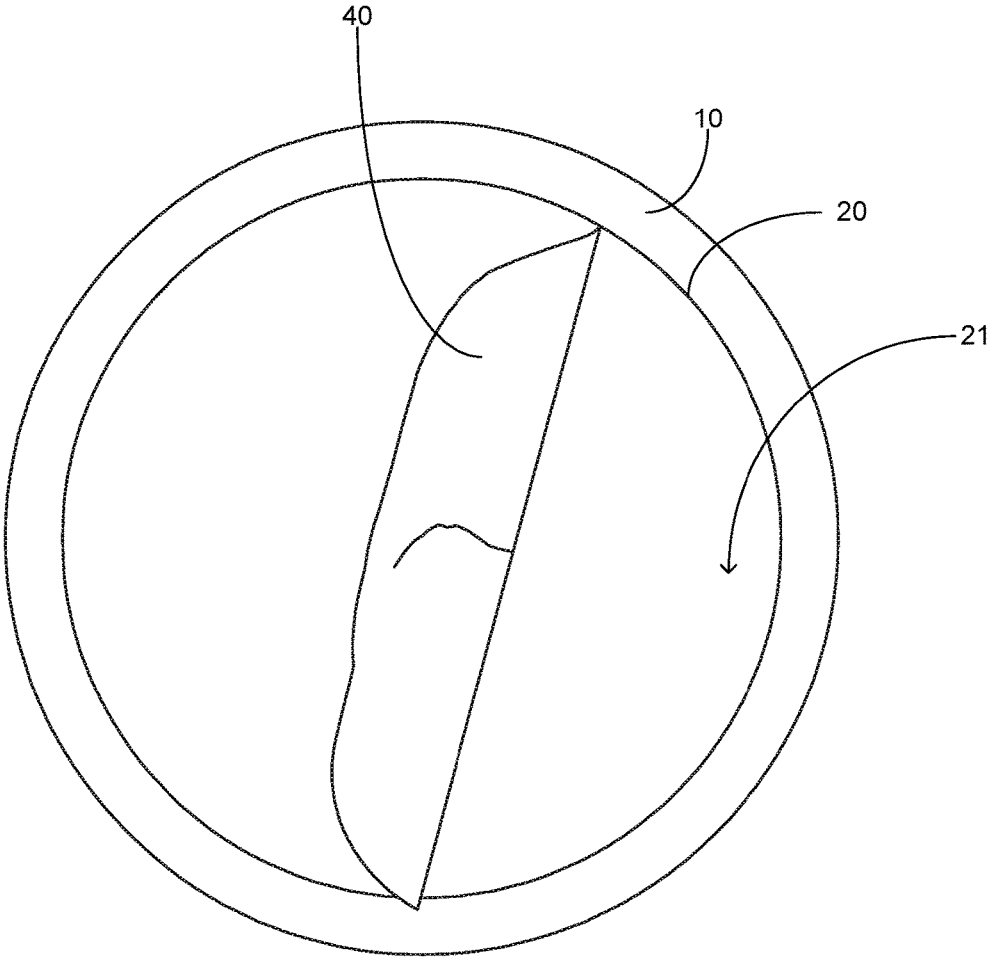
FIG. 2 is a bottom view of the present invention.

The hair collection member 20 is manufactured from a foam pad material and is designed to be releasably secured to the base member 10 as described herein. The hair collection member 20 includes first side 21 that further has an adhesive disposed thereon. While numerous types of adhesives could be utilized to achieve the desired objective, good results have been achieved utilizing a pressure sensitive adhesive. The hair collection member 20 is manufactured from a foam pad material wherein the combination of the foam pad having an adhesive disposed on the first side 21 has proven to be an effective substrate to collect shed hair strands in a shower or bath. The first side 21 of the hair collection member 20 has superposed thereon a protective film 40 that is illustrated herein in FIG. 2. The protective film 40 is manufactured from a suitable material such as but not limited to plastic and is operable to be removed prior to use of the hair collection member 20. The protective film 40 preserves the integrity of the adhesive that is disposed on the first side 21 of the hair collection member 20 until a user is ready to install the hair collection device 100.

As illustrated herein, either all or a portion of the hair collection member 20 can be formed in an alternate shape as opposed to an annular shape. The exemplary embodiment of the hair collection member 20 illustrated herein in FIG. 1 is formed to resemble a wildlife scene. The forming of all or a portion of the hair collection member 20 into various shapes, sizes and scenes provides users options so as to match existing décor in the bathroom of the user. In operation the user will mount the base member 10 in a desired location on the shower or bathtub wall utilizing provided adhesive foam tape or similar material. The hair collection member 20 is releasably secured to the base member 10 using the first fastener 25 and second fastener 27. The protective film is removed from the first side 21 of the hair collection member 20. A user will manually collect shed hair strands in the shower and/or bathtub and place the collected hair strands on the first side 21 of the hair collection member 20. The combination of the foam pad and adhesive superposed on the first side 21 of the hair collection member 20 provides effective retention of the collected hair strands. Ensuing collection of a desired quantity of shed hair strands, the hair collection member 20 is removed and disposed of properly. A second hair collection member 20 is placed on the base member 10 for ensuing use thereof.

It is further contemplated within the scope of the present invention that the second fastener 27 could be sized so as to substantially cover the base member 10. In this configuration a user could utilize the second fastener 27 to temporarily receive and retain hair strands in the absence of the hair collection member 20.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A hair collection device that is operable to releasably retain human hair strands comprising:

a base member, said base member being planar in manner, said base member having a first side and a second side;

a foam pad, said foam pad being planar in manner, said foam pad having a first side and a second side, said second side of said foam pad being adjacent said first side of said base member, said foam pad being superposed said base member, wherein the first side of the foam pad has an adhesive disposed thereon;

a first fastener, said first fastener being disposed on said second side of said foam pad;

a second fastener, said second fastener being disposed on said first side of said base member, wherein said first fastener and said second fastener are configured to releasably secure the foam pad to the base member; and a protective film, said protective film being superposed the first side of said foam pad;

wherein the first side of the foam pad is configured to releasably secure hair strands thereto.

2. The hair collection device as recited in claim 1, wherein said first fastener and said second fastener are manufactured from hook and loop material.

3. A hair collection device that is configured to be secured to a shower wall wherein the hair collection device provides a location to place collected shed hair strands for subsequent disposal thereof comprising:

a base member, said base member being planar in manner, said base member having a first side and a second side, said base member being manufactured from plastic;

a foam pad, said foam pad being planar in manner, said foam pad having a first side and a second side, wherein the first side of said foam pad has a pressure sensitive adhesive disposed thereon, said second side of said foam pad being adjacent said first side of said base member, said foam pad being superposed said base member;

a first fastener, said first fastener being disposed on said second side of said hair collection member;

a second fastener, said second fastener being disposed on said first side of said base member, wherein said first fastener and said second fastener are configured to releasably secure the foam pad to the base member, wherein said first fastener and said second fastener are manufactured from hook and loop material;

a protective film, said protective film being superposed the first side of said foam pad; and wherein the foam pad is configured to removed and disposed of ensuing a collection of hair strands being deposited thereon.

* * * * *